US008397330B2

(12) United States Patent
Pichon et al.

(10) Patent No.: US 8,397,330 B2
(45) Date of Patent: Mar. 19, 2013

(54) ROLLING APPARATUS FOR CLEANING A SUBMERGED SURFACE WITH PARTIALLY HYDRAULIC DRIVE

(75) Inventors: Philippe Pichon, Villeneuve de Riviere (FR); Emmanuel Mastio, Fourquevaux (FR)

(73) Assignee: Zodiac Pool Care Europe, Paris (FR)

( * ) Notice: Subject to any disclaimer, the term of this patent is extended or adjusted under 35 U.S.C. 154(b) by 247 days.

(21) Appl. No.: 12/808,677

(22) PCT Filed: Dec. 17, 2008

(86) PCT No.: PCT/FR2008/052341

§ 371 (c)(1), (2), (4) Date: Sep. 20, 2010

(87) PCT Pub. No.: WO2009/087326

PCT Pub. Date: Jul. 16, 2009

(65) Prior Publication Data

US 2011/0016646 A1 Jan. 27, 2011

(30) Foreign Application Priority Data

Dec. 21, 2007 (FR) ..... 07 08997

(51) Int. Cl.
*E04H 4/16* (2006.01)

(52) U.S. Cl. ..... 15/1.7

(58) Field of Classification Search ..... 15/1.7; 210/167.1, 167.16, 167.17, 416.2, 459; 4/490, 4/496; 134/109, 110, 167 R, 168 R
See application file for complete search history.

(56) References Cited

U.S. PATENT DOCUMENTS

| | | | | |
|---|---|---|---|---|
| 4,852,211 | A * | 8/1989 | Strausak | 15/1.7 |
| 5,197,158 | A * | 3/1993 | Moini | 15/1.7 |
| 6,155,657 | A * | 12/2000 | Erlich et al. | 305/178 |
| 2001/0032809 | A1 * | 10/2001 | Henkin et al. | 210/143 |
| 2003/0159723 | A1 * | 8/2003 | Hui | 134/167 R |
| 2003/0201218 | A1 | 10/2003 | Henkin et al. | |
| 2007/0272273 | A1 * | 11/2007 | Adam | 134/18 |

FOREIGN PATENT DOCUMENTS

| | | |
|---|---|---|
| EP | 1022411 | 7/2000 |
| WO | WO0250388 | 6/2002 |

OTHER PUBLICATIONS

International Search Report in Application No. PCT/FR2009/052341.

* cited by examiner

*Primary Examiner* — Monica Carter
*Assistant Examiner* — Andrew A Horton
(74) *Attorney, Agent, or Firm* — Dean W. Russell; Kilpatrick Townsend & Stockton LLP

(57) ABSTRACT

Detailed is a rolling device for cleaning an immersed surface, including at least one front drive rolling member and a hydraulic circuit which has at least one liquid outlet which is orientated towards the rear, and which is capable of creating a flow of liquid which is discharged from each rear outlet in order to create a hydraulic reaction force, and which has a longitudinal component for driving the device forwards which is not equal to zero and whose value is adapted to create a pressure torque for each front drive rolling member the immersed surface and, alone, to move the device forwards when it is immersed and when each front drive rolling member is lifted from the immersed surface.

7 Claims, 6 Drawing Sheets

Figure 1:
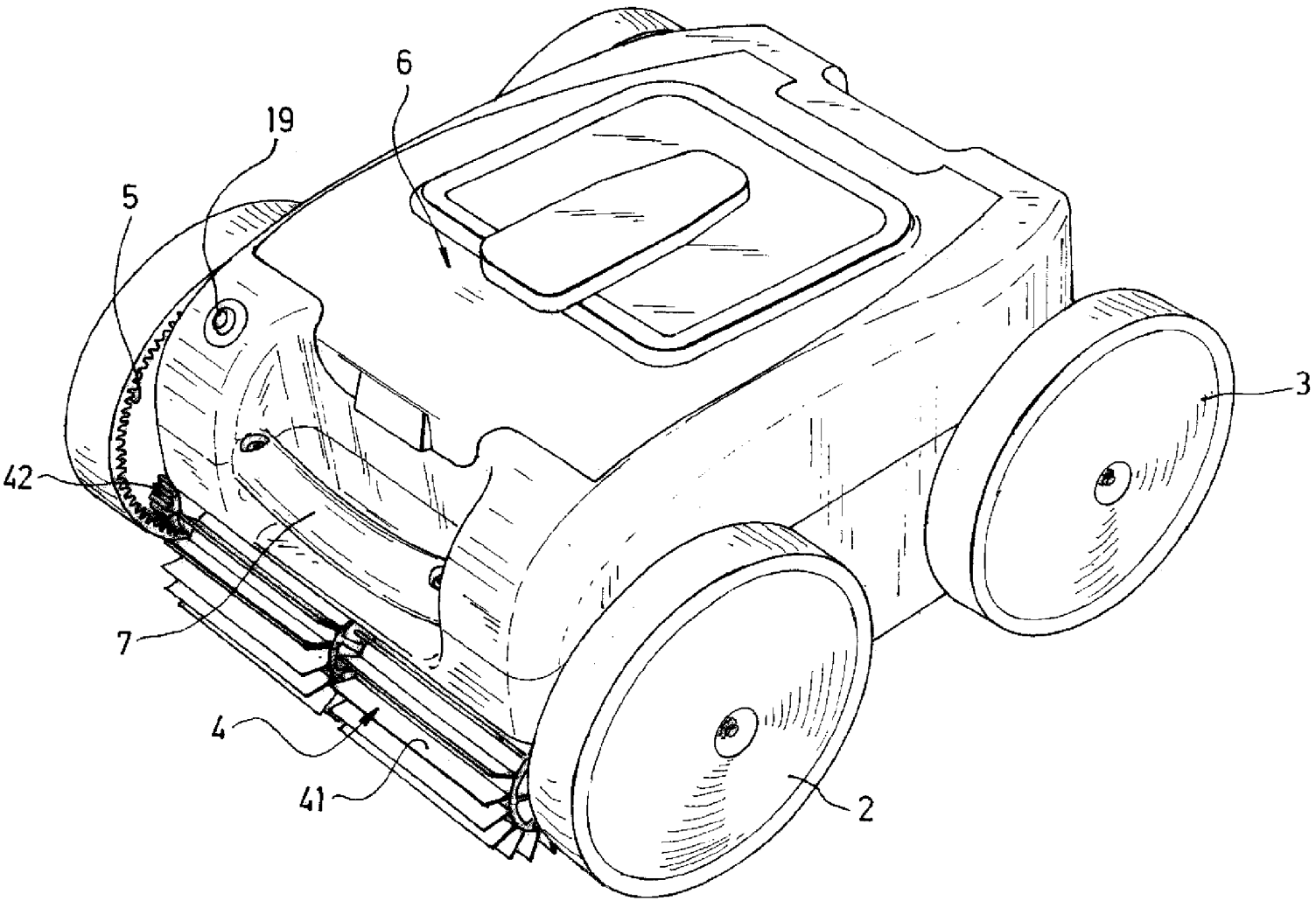

ROLLING APPARATUS FOR CLEANING A SUBMERGED SURFACE WITH PARTIALLY HYDRAULIC DRIVE

CROSS REFERENCE TO RELATED APPLICATIONS

This application is the U.S. national phase of International Application No. PCT/FR2008/052341 filed on Dec. 17, 2008 and published on Jul. 16, 2009 as International Publication No. WO 2009/087326 A2, which application claims priority to French Patent Application No. 0708997 filed on Dec. 21, 2007, the entire contents of both of which are incorporated herein by reference.

The invention relates to a rolling device for cleaning an immersed surface, comprising:

a hollow body, rolling members which have contact zones with the immersed surface which define a rolling plane of the hollow body over the immersed surface, at least one motor for driving at least one rolling member, called the drive rolling member, in order to form a driving device which is capable, via this/these drive rolling members, of rolling the hollow body over the immersed surface in at least one direction of advance and in a main direction of advance, called the longitudinal direction, a front axle which carries at least one front rolling member which is mounted so as to be able to rotate relative to the hollow body about a transverse shaft, each front rolling member having an outer face which is rotationally symmetrical about this transverse shaft so as to travel over the immersed surface, at least one front rolling member protruding towards the front relative to the hollow body so as to first come into contact with any obstacle encountered by the device during its forward movement, a hydraulic circuit comprising:

at least one liquid inlet into the hollow body, located at the base of the body, at least one liquid outlet out of the hollow body, located remotely from the base of the body, a filtration chamber which is provided in the body, a motorized pumping assembly which is capable of providing a flow of liquid between each inlet and each outlet through a filtering device which is mounted in the filtration chamber.

A very large number of different types of device for cleaning an immersed surface have been proposed. US 2003/0201218 and EP 1 022 411 describe rolling devices for cleaning an immersed surface in which at least part of the residual hydraulic energy in a flow leaving the filtering operation can be used to drive and/or direct the device. However, these known devices are capable neither of climbing the vertical walls of a pool, nor of climbing steps, and are not designed for this purpose.

WO 0250388 describes a self-propelled rolling device which comprises electric motors for driving the lateral chains and front and rear rolling members which are formed by rollers. In this type of device, the motorized pumping assembly is arranged vertically, generally at the center of the hollow body, and the suction created at the lower water inlet has a tendency to press the device onto the immersed surface. Such a device is satisfactory and in particular allows the bases of vertical or inclined walls to be passed, and allows the vertical or inclined walls of the swimming pool to be climbed for the purposes of cleaning. It is also capable of climbing the steps of an immersed stairway.

In this regard, it should be noted that it is considered that a rolling device for cleaning an immersed surface, in order to be able to climb the vertical walls and/or climb the steps, must be provided with drive rolling members both at the front and at the rear of the device, and even lateral chains in order to prevent any blockage when passing stair nosings (in the whole text, the expression "stair nosings" is intended to refer to any convex connection edge between a vertical wall and a horizontal wall of a stair).

However, such a device is relatively heavy, consumes energy and is costly to purchase and use.

An object of the invention is therefore generally to provide a rolling device for cleaning an immersed surface which has the same advantages as the device of WO 0250388, in particular which allows the inclined or vertical walls of the swimming pool and the immersed steps to be cleaned, without requiring either lateral chains or rear drive rolling members, and which therefore has lower purchase and operating costs, better efficiency and a lower weight.

In this manner, an object of the invention is to provide a rolling device for cleaning an immersed surface whose performance/cost ratio is improved compared with that of prior devices. More specifically, an object of the invention is to provide a device of this type whose cost can be substantially reduced with performance levels which are equivalent to or even greater than those of known devices.

To this end, the invention relates to a rolling device for cleaning an immersed surface comprising:

a hollow body, rolling members which have contact zones with the immersed surface which define a rolling plane of the hollow body over the immersed surface, at least one motor for driving at least one rolling member, called the drive rolling member, in order to form a driving device which is capable, via this/these drive rolling members, of rolling the hollow body over the immersed surface in at least one direction of advance and in a main direction of advance, called the longitudinal direction, a front axle which carries at least one front rolling member which is mounted so as to be able to rotate relative to the hollow body about a transverse shaft, each front rolling member having an outer face which is rotationally symmetrical about this transverse shaft so as to travel over the immersed surface, at least one front rolling member protruding towards the front relative to the hollow body so as to first come into contact with any obstacle encountered by the device during its forward movement, a hydraulic circuit comprising:

at least one liquid inlet into the hollow body, located at the base of the body, at least one liquid outlet out of the hollow body, located remotely from the base of the body, a filtration chamber which is provided in the hollow body, a motorized pumping assembly which is capable of providing a flow of liquid between each inlet and each outlet through a filtering device which is mounted in the filtration chamber, wherein:

at least one front rolling member of the front axle is a front drive rolling member which is coupled to at least one drive motor so as to be rotated thereby, the hydraulic circuit comprises at least one liquid outlet which is orientated towards the rear, called the rear outlet, the hydraulic circuit is capable of creating a flow of liquid which is discharged from each rear outlet with a longitudinal speed component in order to create, by means of reaction, forces whose resultant, called the hydraulic reaction force, has a longitudinal component for driving the device forwards which is not equal to zero and whose value is capable alone of moving the device forwards when it is immersed, when each front drive rolling member is lifted from the immersed surface and when the device is resting with the base of the hollow body in contact with a stair nosing, the longitudinal component of the hydraulic reaction force resulting from the reaction of the liquid flow discharged from each rear outlet being applied at a center of pressure located at a distance from the rolling plane which is greater than the distance between the rolling plane and the center, called the apparent center of gravity of the device, where the resultant of the weight and the Archimedean force (center of mass between the center of gravity and the center of application of the buoyancy) is applied, in order to create a pressure torque for each front drive rolling member on the immersed surface.

The inventors have found that this arrangement in particular allows in practice at least part of the residual hydraulic energy in the discharge flow to be used, not only to contribute to driving the device, but instead also and in particular for ensuring the permanent equilibrium thereof with the front drive rolling members which are in contact with the immersed surface, including on inclined or vertical walls and ensuring that the device is able, on the one hand, to pass the base of a vertical wall, that is to say, at the junction between a base wall (horizontal or slightly inclined) and a vertical wall and, on the other hand, to move over steps, without any risk of becoming blocked or being inverted, whilst providing efficient cleaning of these zones.

In a device according to the invention, the longitudinal component of the hydraulic reaction force allows the front drive rolling members to be pressed into contact with a vertical wall which is encountered at the end of a path over a horizontal or slightly inclined base wall so that the front of the device is lifted along the vertical wall. In this manner, advantageously and according to the invention, the value of the pressure torque is adapted so as not to prevent the front portion of the device from overcoming a front obstacle—in particular a vertical wall—under the action of each front drive rolling member, in particular when the device is traveling over a horizontal immersed surface.

Furthermore, when the front drive rolling members are lifted from the immersed surface and no longer allow the device to be driven, for example, when passing a stair nosing, the longitudinal component of the hydraulic reaction force generates a pressure torque which allows the device to be tilted in the direction for returning the front drive rolling members thereof into contact with the immersed surface. This in particular ensures stair nosings are passed under any circumstances regardless of the size of the steps.

Preferably, advantageously and according to the invention, the hydraulic circuit is adapted so that the value of the longitudinal component of the hydraulic reaction force is capable alone of driving the device forwards and upwards when the longitudinal direction thereof forms with the horizontal an angle of between 0° and 85°—in particular preferably for any angle between 0° and 90°.

In all of the text, the expression "apparent weight" is intended to refer to the resultant which is directed downwards (the device being more dense than the liquid and heavier than the volume of liquid which it displaces), between the weight (generated by gravity) and the Archimedean force. This apparent weight is applied at the apparent center of gravity, which is the center of mass between the center of gravity where the weight is applied and the application center of the Archimedean force.

The apparent weight of the device immersed in the liquid when it is rolling over a vertical wall forms an inversion torque which tends to lift the device from a vertical wall counter to the application force of the device on the immersed surface created by the intake of liquid in each liquid inlet. In a device according to the invention, the hydraulic circuit is adapted so that the value of the pressure torque keeps the device with the rolling members thereof in contact with the vertical wall counter to this inversion torque. That is to say, the resultant of the torque created by the apparent weight of the device immersed in the liquid when it travels over a vertical wall and the application force of the device over the immersed surface created by the intake of liquid in each liquid inlet forms an inversion torque which has a tendency to lift the device from a vertical wall (the application force resulting from the intake not being sufficient) and the hydraulic circuit is adapted so that the value of the pressure torque is greater than that of this inversion torque.

In this manner, the pressure torque created by the longitudinal component of the hydraulic reaction force allows each front drive rolling member to be kept in contact with the vertical wall so that the device is driven upwards on the one hand by each front drive rolling member and, on the other hand, by the longitudinal component of the hydraulic drive force.

Preferably, advantageously and according to the invention, the hydraulic circuit is adapted so that the value of the pressure torque is greater than that of the inversion torque created by only the apparent weight of the device immersed in the liquid when it is rolling over a vertical wall. In this manner, any contribution of the suction to holding the device in contact with a vertical wall is not necessary for this retention.

With equivalent levels of suction and cleaning performance, a device according to the invention may be provided with a driving device which is much less powerful and which therefore has lower consumption and costs. Consequently, the device is also generally smaller and lighter which, in addition to the savings made, is a significant advantage for the user, in particular in terms of handling, transport and storage of the device.

There are an infinite number of ways of producing a device whose hydraulic circuit provides a hydraulic reaction force and a pressure torque in accordance with the invention, which define the necessary and adequate conditions for the hydraulic circuit of the device allowing the problem set out above to be overcome. Consequently, the invention extends to all embodiments which may be envisaged in order to obtain such a hydraulic circuit. For each embodiment of a rolling device for cleaning an immersed surface, obtaining a hydraulic reaction force and a corresponding pressure torque according to the invention results from a simple mechanical analysis and a selection, which is equally simple, of the definition of the hydraulic circuit and the components of the device (for example, the position and the orientation of each liquid outlet, the selection of the appropriate characteristics for the motorized pumping assembly . . . ). This analysis and this selection can be carried out for each specific configuration of the device, without it being possible to define specific structural criteria applicable in a universal manner. The achievement of a hydraulic reaction force and a pressure torque in accordance with the invention can be readily verified from a specific device, in particular by means of motion tests.

This being the case, the invention can be used in a manner which is more particularly advantageous for specific embodiments of a rolling device for cleaning an immersed surface as set out below.

Advantageously and according to the invention, only the front axle is a drive axle, the device being moved over the immersed surface only by one or more front drive rolling members and by the longitudinal component of the hydraulic reaction force.

In this manner, a device according to the invention can be driven only by the longitudinal component of the hydraulic reaction force and by the front drive axle thereof. That is to say, the only drive rolling members of the device according to the invention are constituted by one or more front drive rolling members, any other drive rolling members of the device being non-driving, that is to say, mounted so as to rotate freely relative to the hollow body.

In this regard, it should be noted that a device according to the invention is preferably of the so-called uni-directional type, that is to say, driven principally in the longitudinal direction in a preferred direction of advance in which it carries out the recovery of debris and filtering, although there is nothing to prevent such a device from also being able to be provided with the possibility of moving in a backward direction, for example, in order to disengage itself from obstacles.

In this manner, in this variant, advantageously and according to the invention, the rolling members and drive motor(s) are capable of moving the device in the longitudinal direction principally in a preferred driving direction.

However, the invention can also be used for a device of the type which is called bi-directional, that is to say, which is capable of being driven in the longitudinal direction both in one direction and the other and carrying out the recovery of debris and the filtering in one or other of these two directions. In this variant, the features mentioned above can be complied with in each driving direction, or, instead, in only one of the two driving directions. Furthermore, preferably, advantageously and according to the invention, only the front axle, that is to say, the axle which is directed towards the front relative to the current movement direction, is a drive axle. In this manner, a device according to the invention may have two axles which are mutually opposed in the longitudinal direction, each axle alternatively being able to be a drive axle, that is to say, driven by one or more drive motors(s) in the movement direction in which the axle is orientated towards the front.

A device according to the invention may be provided with various types of rolling members, the number and type of which (wheels, transverse rollers, semi-rollers . . . ) are irrelevant. However, a device according to the invention may advantageously have no lateral chains. The rolling members thereof may advantageously be constituted in particular only by a front drive axle and a rear non-drive axle. In any case, the rolling members define a (theoretical) rolling plane, that is to say, they are capable of having contact zones with the immersed surface which are coplanar.

In an advantageous embodiment, the device according to the invention comprises a front drive axle which is provided with two front drive wheels, one at each side, and a rear non-drive axle, for example, provided with a rear wheel or castor which is mounted so as to be able to pivot freely about a vertical axis and rotate freely about a horizontal axis, or two rear non-drive wheels, one at each side, the device being supported on four wheels. In this manner, a device according to the invention is advantageously guided over an immersed surface by the front drive axle and a rear non-drive axle which comprises two rear wheels which can rotate freely, one at each side. Each front drive wheel has a diameter which is preferably greater than 10 cm. Preferably, the diameter of each front drive wheel is less than 50 cm. Advantageously and according to the invention, the diameter of each front wheel is between 15 cm and 30 cm. At least one roller or cleaning brush may advantageously be provided so as to be rotatably mounted between the two front drive wheels, preferably driven in the same rotation direction as the front drive wheels and at a rotation speed which is greater than that of the front drive wheels. Other construction variants are possible and compatible with the invention.

In a device according to the invention, although the longitudinal component of the hydraulic reaction force may be sufficient alone to allow the device to be moved, when the front drive axle is in contact with a wall of the immersed surface, the movement speed of the device is determined and imposed by the rotation driving speed of the front drive rolling members and not by the longitudinal component of the hydraulic reaction force.

The invention can in particular be advantageously used for a device of the type which is driven by means of (an) electric motor(s).

For example, a device according to the invention comprises two independent electric motors, one being coupled to at least one rolling member which is arranged at one side of the device, whilst the other is coupled to at least one rolling member which is arranged at the other side of the device, so that the independent control of these two electric motors also allows the device to be directed during its movements over the immersed surface.

Furthermore, advantageously and according to the invention, the hydraulic circuit is adapted so that the flow of liquid being discharged from each rear outlet forms, with the longitudinal direction, an angle $\beta$ which is not equal to zero and which is less than 45°, so that the hydraulic reaction force resulting from the reaction of the flow of liquid being discharged from each rear outlet has a component, called the application component, orthogonal relative to the longitudinal component, the application component being orientated towards the rolling plane and having a lower value than that of the longitudinal component. This application component tends to keep the device according to the invention, and more specifically the rear axle, in contact with the wall of the immersed surface.

Advantageously, a device according to the invention further comprises at least one—in particular one and only one—electric pumping motor which is coupled to at least one—in particular one and only one—axial pumping propeller which is interposed in the hydraulic circuit, and a cable for supplying electrical power to the device from a control unit and an electrical current source which are external with respect to the immersed surface. Such an electric pumping motor does not act as a drive motor, that is to say, it is not coupled to a drive rolling member. The features of this electric pumping motor and the associated pumping propeller which constitute the motorized pumping assembly are selected so that the hydraulic circuit provides the hydraulic reaction force and the pressure torque as mentioned above.

Advantageously, a device according to the invention comprises an axial pumping propeller which is arranged immediately upstream of a rear outlet, this axial pumping propeller having a rotation axis which is inclined relative to the longitudinal direction through an angle $\alpha$ which is 5° smaller than the angle $\beta$ formed, relative to the longitudinal direction, by the flow of liquid being discharged from the rear outlet. In an advantageous embodiment, the axis of the propeller is at least substantially parallel with the direction of the flow of liquid being discharged from the rear outlet (which means that the angle α is of the same order of magnitude as the angle β).

Furthermore, advantageously and according to the invention, the length of the front portion of the device which extends between the apparent center of gravity Ga and the extreme front portion thereof is less than 35 cm, in particular in the order of from 20 cm to 30 cm. In this manner, the cleaning of steps is improved.

The invention also relates to a rolling device for cleaning an immersed surface, characterized in combination by all or some of the features mentioned above or below.

Figure 2:
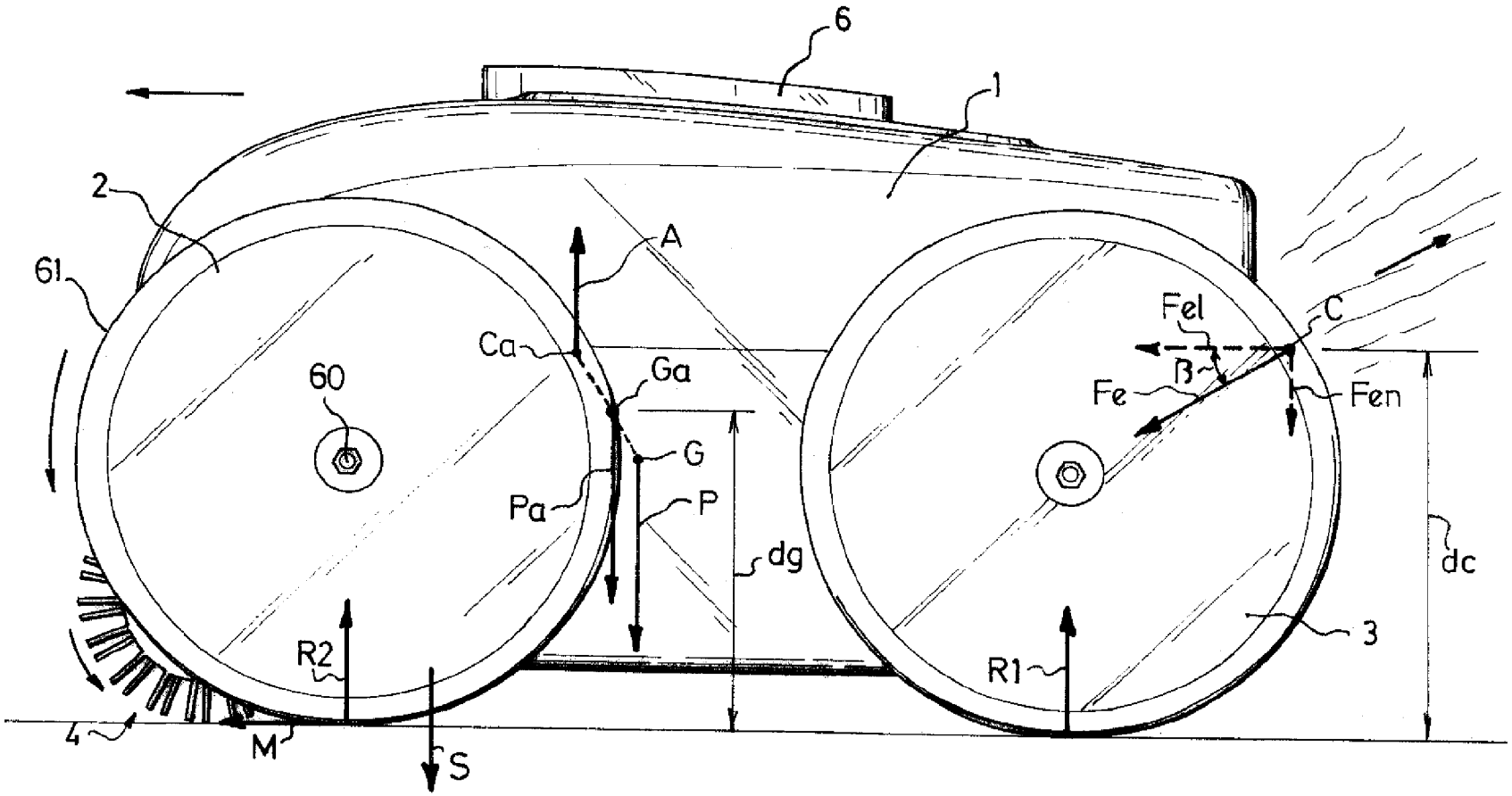
Figure 3:
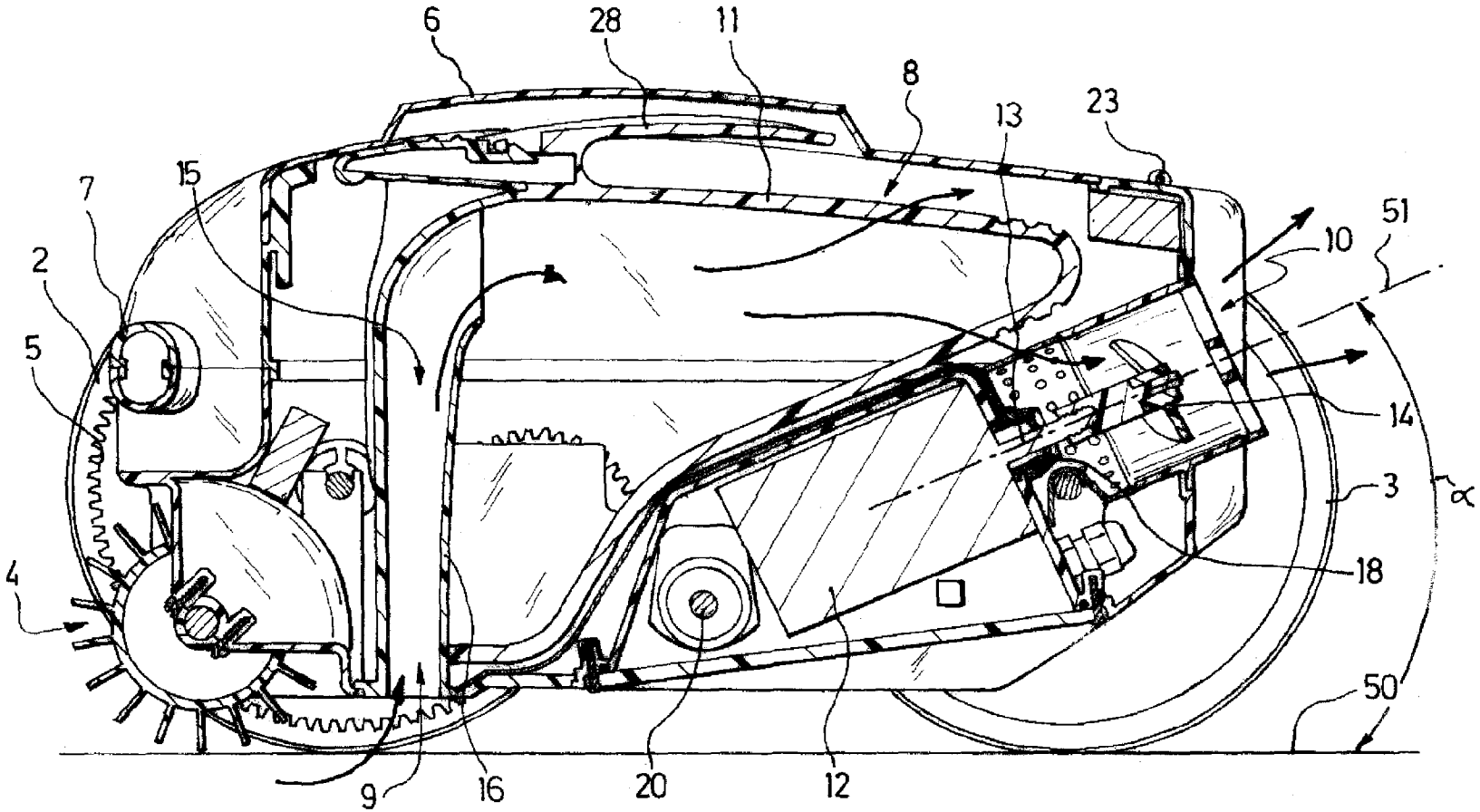
Figure 4:
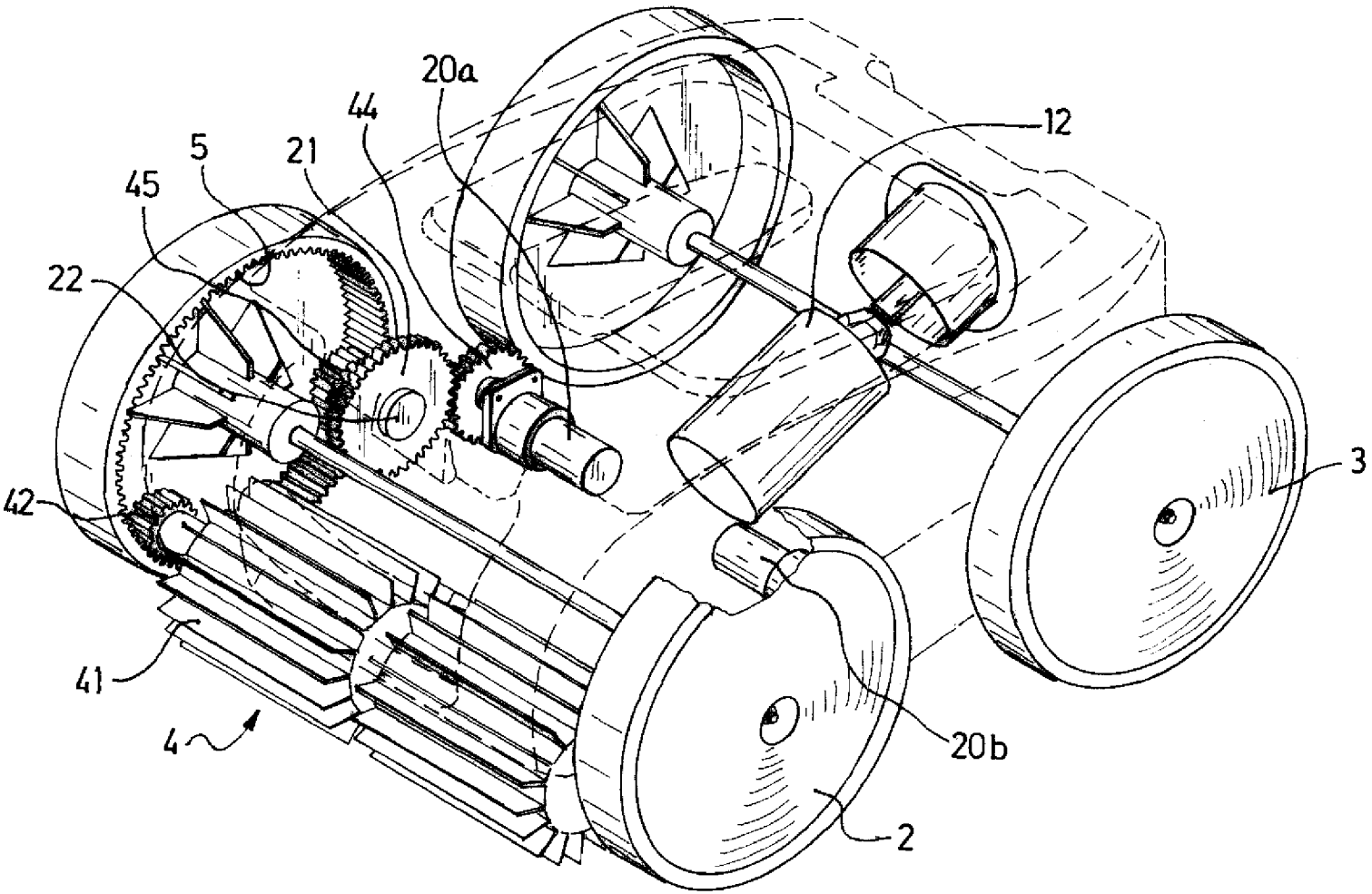
Figure 5:
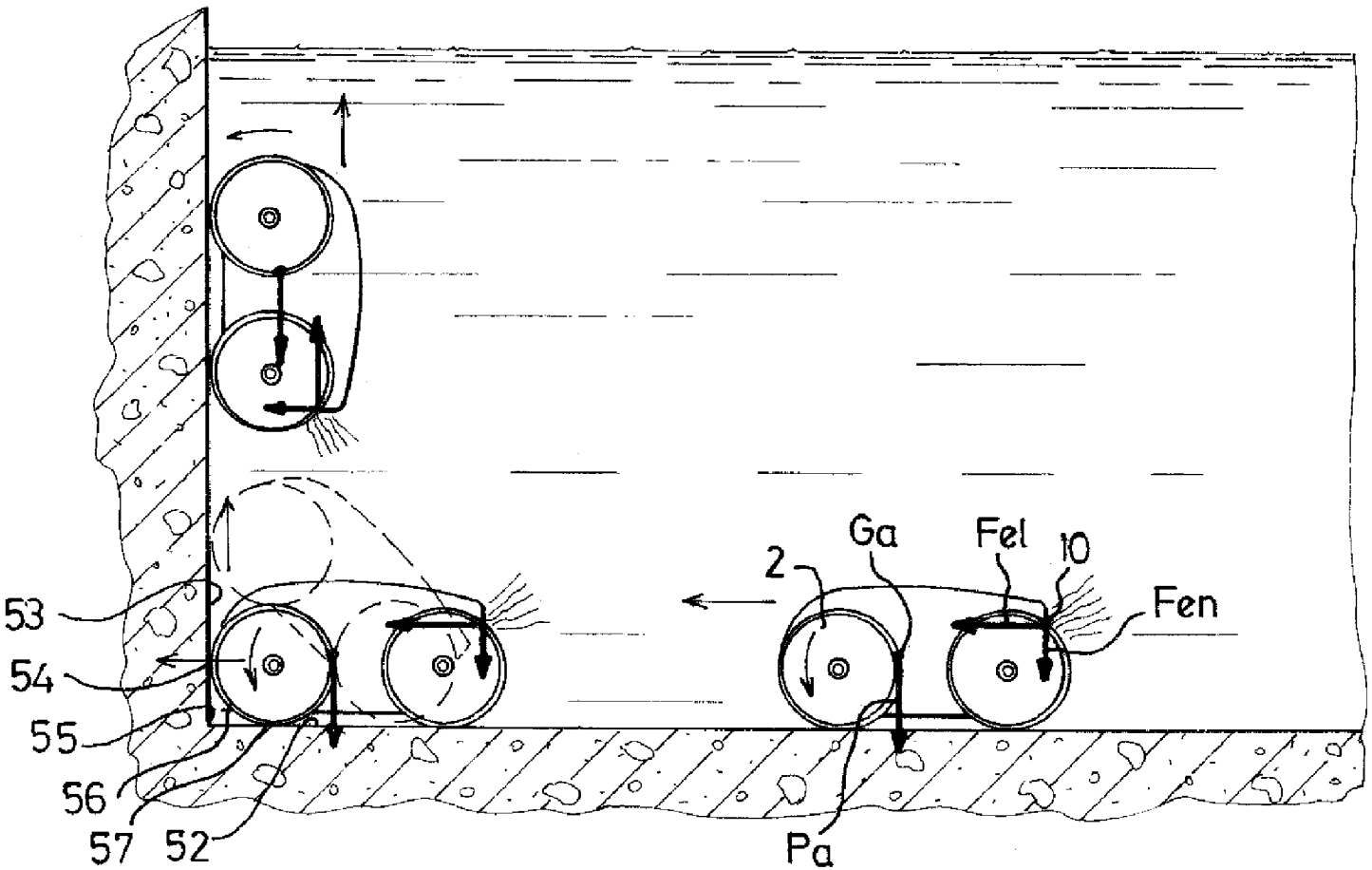
Figure 6:
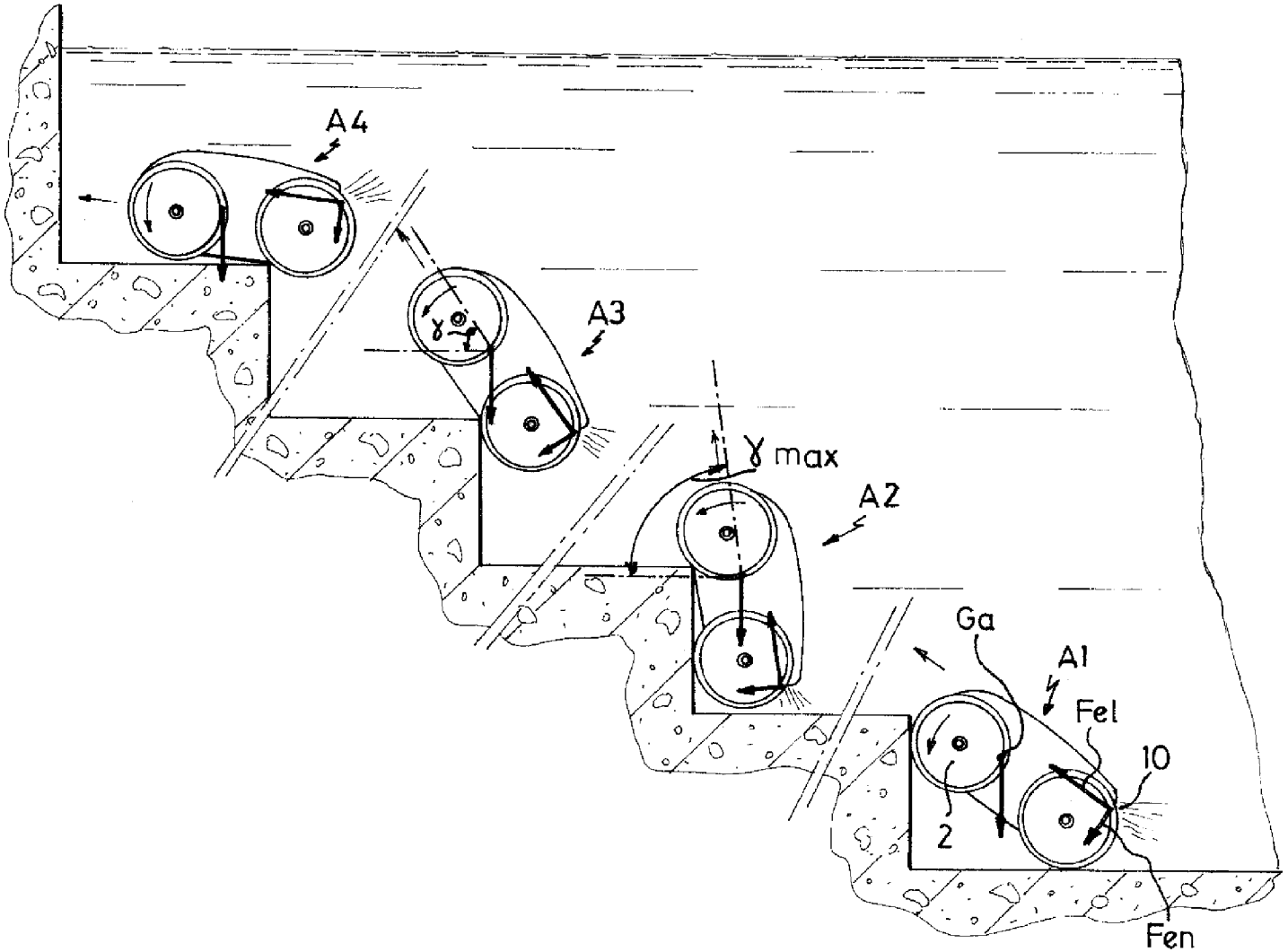

Other objectives, features and advantages of the invention will be appreciated from a reading of the following description given purely by way of non-limiting example and with reference to the appended drawings, in which:

FIG. 1 is a schematic perspective view of an embodiment of a device according to the invention, FIG. 2 is a schematic profile view of the device of FIG. 1, FIG. 3 is a schematic section through a vertical longitudinal plane of the device of FIG. 1, FIG. 4 is a schematic perspective view of a portion of the device of FIG. 1, FIG. 5 is a schematic view illustrating the movement of the device of FIGS. 1 to 4, at the base of the vertical wall, FIG. 6 is a schematic view illustrating the movement of the device of FIGS. 1 to 4 when climbing an immersed stairway.

In the Figures, the scales and proportions have not been strictly complied with for the purposes of illustration and clarity.

In all of the following detailed description with reference to FIGS. 1 to 4, unless indicated otherwise, each component of the cleaning device is described as it is arranged when the device is moving normally over a horizontal immersed surface in a preferred direction of advance.

A device according to the invention comprises a hollow body 1 and rolling members 2, 3, 4 for guiding and driving the hollow body 1 over an immersed surface in at least one preferred direction of advance and in a main direction of advance, called the longitudinal direction, parallel with the immersed surface when the device is carrying out the normal cleaning movement over this immersed surface.

This hollow body 1 is formed principally by a concave housing which delimits a main chamber. This concave housing is, for example, produced by means of molding or rotational molding. This housing is preferably produced from a thermoplastic material, such as polyethylene, polypropylene, polyamide, ABS, PMMA or any equivalent material. A handle 7 which is located at the front of the device allows a user to carry it, in particular in order to remove it from a pool or immerse it in a pool.

This hollow body 1 has a central chamber which is capable of forming a filtration chamber 8. This central chamber is delimited by a lower wall which extends in a substantially horizontal plane; by lateral walls which generally extend in vertical planes; by a front wall which generally extends in a vertical plane, orthogonal relative to the planes of the vertical lateral walls; and by a rear wall which generally extends in a vertical plane orthogonal relative to the planes of the vertical lateral walls.

The lower wall has an opening which extends transversely in the region of the front wall so that liquid can return to the central chamber via this lower transverse opening.

The rear wall comprises a cylindrical opening. In this manner, the cylindrical opening which is provided in the rear wall of the housing is longitudinally offset from the lower transverse opening which is provided in the lower wall. Furthermore, this cylindrical opening is provided in the upper portion of the housing in such a manner that it is also vertically offset from the lower transverse opening.

As illustrated in particular in FIG. 3, this hollow body 1 comprises a filtration chamber 8 which has a liquid inlet 9 located at the base of the hollow body 1, that is to say, in the lower portion of the device, a liquid outlet 10 which is arranged opposite the base of the body 1, that is to say, in the upper portion of the device, and a hydraulic circuit which is capable of providing a flow of liquid between the liquid inlet 9 and the liquid outlet 10 through a filtering device 11.

The transverse opening which is provided in the lower wall of the housing forms the liquid inlet 9 of the device and the cylindrical opening which is provided in the rear wall of the device forms the liquid outlet 10 of the device.

Preferably, the liquid inlet 9 and the liquid outlet 10 are longitudinally offset but are both centered on the same longitudinal vertical center plane of the device.

The central chamber of the hollow body 1 is capable of receiving the filtering device 11. The filtering device 11 is arranged between the liquid inlet 9 and the liquid outlet 10.

This filtering device 11 may be of any known type. It is preferably removably mounted in the hollow body 1, although the invention can be used for a device whose filtering device might be non-removable.

For example, the filtering device 11 comprises a rigid frame and a filtering material carried by this rigid frame. Such a filtering device 11 is therefore self-supporting and can be readily handled by a user.

The device also comprises a flap 6 for access to this filtering device 11. This access flap 6 forms an upper wall of the hollow body 1 and covers it. In the embodiment illustrated, this flap 6 is provided on the upper portion of the device so that a person using the device can readily open the flap 6 and remove the filtering device 11. The access flap 6 is articulated to the body 1 of the device by means of hinges 23 which are provided at the rear of the device.

Advantageously, the rigid frame further has two ribs which extend laterally at each side of the filtering device 11. These ribs have shapes and dimensions which correspond to and complement the shapes and dimensions of grooves which are fixedly joined to the hollow body 1. These grooves which are fixedly joined to the hollow body 1 extend vertically along the inner faces of the vertical lateral walls of the hollow body 1. The ribs of the filtering device 11 are therefore capable of co-operating with the grooves of the hollow body 1 of the device. In this manner, the removal of the filtering device 11 is the result of a translation movement of the filtering device 11 along the grooves of the hollow body 1. A user can therefore readily remove the filtering device 11 from the hollow body 1 in order, for example, to clean it. After the filtering device 11 has been cleaned, a user can readily reintroduce the filtering device 11 into the hollow body 1 by orientating the filtering device 11 so that the ribs of the filtering device 11 are opposite the grooves of the hollow body, then by sliding the filtering device 11 in the hollow body 1. The filtering device 11 further comprises a handle 28 which is provided on an upper portion of the filtering device 11 in order to facilitate handling of the filtering device 11.

In the preferred embodiment illustrated in the Figures, the rolling members for guiding and driving the device comprise a front axle which comprises front drive wheels 2, one at each side, and a rear axle which comprises rear non-drive wheels 3, one at each side.

Furthermore, preferably and as illustrated in the Figures, the device comprises brushes 4 which are arranged at the front of the device. These brushes 4 are intended to brush the immersed surface and move the debris which are brushed towards the rear of the device in the direction of the liquid inlet 9 which is provided below the device.

The device further comprises, for driving the front drive wheels 2, at least one electric motor 20 which is supplied with electrical energy via the cable 19 which is connected to the body 1. Preferably, the device comprises two drive motors 20*a*, 20*b*, one at each side, for independently driving each of the front wheels 2, respectively. To this end, each front wheel 2 has an internal toothed arrangement 5 which co-operates with a drive pinion 45 which is driven by the corresponding drive motor 20*a*, 20*b* by means of a pinion 44 which is fixedly joined in terms of rotation to the shaft of the corresponding motor 20*a*, 20*b* and an intermediate pinion 21 which is driven by the pinion 44 of the motor, the drive pinion 45 and the intermediate pinion 21 both being coupled to the same shaft 22 which is mounted so as to be fixed in terms of rotation relative to the body 1.

These brushes 4 may be of any type. According to one embodiment of the invention, the device comprises two coaxial front brushes 4. Each brush 4 is capable of being rotated about an axis which extends in a direction, which is called the transverse direction and which is perpendicular relative to the longitudinal direction. Each brush 4 comprises a plurality of fins 41 which extend radially from a brush shaft which forms the rotation axis of the brush 4. The fins 41 are, for example, of rubber or a strong plastics material.

Furthermore, the brushes 4 are preferably also rotated in the same direction as the front wheels 2, by at least one electric motor 20, 20*a*, 20*b* for driving the front wheels 2 by means of a gear system. According to this embodiment, the internal toothed arrangement 5 of each front drive wheel 2 co-operates with a pinion 42 which is fixed to one end of the shaft of a brush 4 so that a rotation of the wheel 2 brings about, by means of the toothed arrangement 5 and the pinion 42, the rotation of the shaft of the brush 4 and therefore the rotation of the brush 4 in the same direction but with a higher angular rotation speed. The brush 4 is therefore caused to slide over the immersed surface and to sweep it immediately upstream of the inlet 9.

In this manner, in the embodiment illustrated, the rolling members are constituted by the front drive wheels 2, rear non-drive wheels 3 and brushes 4 which have some degree of involvement in driving and guiding the device over the immersed surface. Preferably, in a device according to the invention, the longitudinal driving resulting from the rotation of the brushes 4 is negligible, that is to say, the speed of the device remains the same, regardless of the rotation speed of the brushes 4. The invention can nonetheless also be used with a device in which at least one front drive brush or at least one front drive roller drives the device longitudinally forwards, that is to say, acts as a front drive rolling members.

In any case, the rolling members 2, 3, 4 have zones which are intended to come into contact with the immersed surface and which are coplanar and define a theoretical rolling plane 50. The longitudinal direction of advance of the device is parallel with this theoretical rolling plane 50.

The front wheels 2 preferably have a diameter greater than 10 cm and less than 50 cm, in particular between 15 cm and 30 cm. The same applies to the rear wheels 3. In this manner, they facilitate the passing of obstacles and have improved traction. Advantageously, their peripheral tread 61 is formed by or covered with a non-skid material which is preferably compatible with all the surface states of the immersed surface which may be encountered, that is to say, with all the constituent materials of this immersed surface (concrete, tiling, liner, . . . ).

The front wheels 2 and the brushes 4 constitute front rolling members 2, 4 which protrude forwards relative to the other constituent elements of the device, in particular the hollow body, in order to form the extreme front portion of the device and first come into contact with an obstacle which is encountered during the forward movement, for example, a vertical wall as illustrated in FIG. 5. In particular, the front drive wheels 2 come into contact first with an obstacle which is formed by a wall 53 which is orthogonal relative to the wall, called the travel wall 52, of the immersed surface coincident with the rolling plane 50, in accordance with a contact zone 54 which is located in the same horizontal plane as the rotation shaft 60 of these front wheels 2. It is easy to understand that this condition is complied with as soon as the wall 53 orthogonal relative to the travel wall 52 has a connection zone 55 with the travel wall 52 that has a radius of curvature which is less than the radius of curvature of the travel surface 61 of the front wheels 2 (the portion 56 of the travel surface 61 of the front wheels 2 extending between this contact zone 54 and the contact zone 57 of the front wheels 2 with the travel wall 52 no longer being in contact with the immersed surface).

A device according to the invention comprises a motorized liquid pumping device which comprises an electric pumping motor 12 which has a rotating drive shaft 13 which is coupled to an axial pumping propeller 14 which is rotated by the motor 12 about an axis 51. The motor 12 is supplied with electricity by means of a supply cable 19 which is connected to the body 1 of the device and which is connected at the outer side of the pool to an electrical power supply unit. The propeller 14 is interposed in the hydraulic circuit in order to generate therein a flow of liquid between the liquid inlet 9 and the liquid outlet 10. The liquid outlet 10 is directly opposite the pumping propeller so that the liquid flows out of the liquid outlet 10 in a direction which corresponds to the liquid flow generated by the pumping propeller, this flow having a speed which is orientated in accordance with the rotation axis 51 of the propeller 14.

The liquid outlet 10 is located at the rear of the hollow body and is orientated so that the flow of liquid flows out of the liquid outlet 10 with a speed which is orientated backwards and upwards, inclined relative to the longitudinal direction and the rolling plane 50 in accordance with an angle of inclination $\beta$ greater than 0° and less than 90°, preferably less than 45°, in particular in the order of 30°. The liquid outlet 10 is formed by a cylindrical portion which is generated by means of revolution and which forms a fairing for the propeller 14 and determines the direction of the liquid flow. The orientation of the axis of this cylindrical portion therefore determines the value of the angle of inclination $\beta$ of the flow of liquid at the outlet 10. Other construction variants are possible, for example, with deflecting means which allow the flow of liquid to be orientated in a predetermined direction which is fixed or can even be adjusted by the user.

The pumping propeller 14 also has an orientation which allows a flow of liquid to be generated with a horizontal component towards the rear.

Preferably, the pumping propeller 14 has an inclined rotation axis which forms, with the longitudinal direction and with the theoretical rolling plane 50, an angle $\alpha$ which is not equal to 0° and 90°. Preferably, the angle $\alpha$ is less than 45°, in particular in the order of 30°. Preferably, the angle of inclination $\alpha$ of the axis of the pumping propeller 14 corresponds at least substantially to the angle of inclination $\beta$ of the flow of liquid orientated by the rear liquid outlet 10. Advantageously and according to the invention, the difference between these two angles $\alpha$ and $\beta$ is less than 5° at one side or the other. This propeller 14 is rotated by the pumping motor 12 which preferably has a rotating drive shaft 13 which is parallel with the rotation axis of the propeller 14.

According to the invention, the pumping motor 12 is arranged below the hydraulic circuit, entirely at the outer side of this hydraulic circuit which bypasses the pumping motor 12 entirely at the top. The rotating shaft 13 of the pumping motor 12 extends through a lower inclined wall which delimits the hydraulic circuit. The sealing is provided by an O-ring 18. In this manner, the filtering device 11 of the hydraulic circuit can be removed from the device via the top of the device as mentioned above, without being impeded by the pumping motor 12. Only the pumping propeller 14 (and not the pumping motor 12) is arranged in the hydraulic circuit so as to be able to provide the liquid flow. This pumping propeller 14 is arranged at the rear of the device, close to the liquid outlet 10. That is to say, the pumping propeller 14 and the liquid outlet 10 form the end portion of the hydraulic circuit.

FIG. 3 illustrates with arrows the flow of liquid in the hollow body 1 of the device. Liquid enters the hollow body 1 via the liquid inlet 9 which is arranged below the device. This liquid passes into a liquid inlet column 15 in order to reach the filtering device 11. The liquid inlet column 15 has an upper opening which opens into the filtering device 11, at the upper end of a rear separation wall 16 of this inlet column 15. This filtering device 11 allows the liquid to pass via the filtering material and retains the solid debris. The filtered liquid reaches the liquid outlet 10 and is discharged at the rear of the device into the pool from which it originates.

Since the liquid outlet 10 is opposite the pumping propeller 14, the liquid flows out of the device via this outlet 10 with a speed V which is orientated at least substantially in accordance with the axis 51 of the pumping propeller 14 and which has a longitudinal component towards the rear which brings about, by means of reaction, forces whose resultant, called hydraulic reaction force Fe, has a longitudinal drive component Fel which is orientated towards the front and which is involved in driving the device over the immersed surface.

The orientation of the hydraulic reaction force Fe created by the discharge flow and therefore the size of the longitudinal component Fel thereof are dependent on the inclination β relative to the theoretical rolling plane 50, the speed of the flow of liquid being discharged from the liquid outlet 10. Preferably, this inclination β is between 15° and 45°, for example, in the order of 30°. The rolling plane 50 is the theoretical plane defined by the contact zones of the rolling members 2, 3, 4 with the immersed surface. This rolling plane 50 is horizontal when the immersed surface is planar horizontal. The rolling plane 50 is further parallel with the longitudinal direction.

The hydraulic reaction force Fe and therefore also the longitudinal drive component Fel thereof, apply at a theoretical application point, which is called the center of pressure C and whose position which is fixed relative to the device can be determined in a manner well known per se, in particular by means of configuration and/or analysis of the geometry of the hydraulic circuit and/or by means of calculation and/or data-processing simulation and/or by means of tests carried out on an exemplary device during operation.

Furthermore, the device has a center of gravity G where the weight P is applied and an application center Ca of the buoyancy A. The resultant of the weight P and the buoyancy A is the apparent weight Pa which is applied at a center, called the apparent center of gravity Ga, which is the mass center of the center of gravity and the center of application Ca. The device is also subject to the reaction forces R1 and R2 of the immersed surface on the wheels 2, 3 thereof.

As can be seen in FIG. 2, the distance dc between the center of pressure C and the rolling plane 50 is greater than the distance dg between the apparent center of gravity Ga and the rolling plane 50. Consequently, the longitudinal component Fel of the hydraulic reaction force Fe brings about on the device a torque called pressure torque which has a tendency to urge the front drive rolling member 2 and the brush 4 into abutment with the immersed surface.

The hydraulic reaction force Fe also has a component, called the application component Fen, normal relative to the rolling plane 50, which also has a tendency to press it against the immersed surface. Finally, the reduced pressure for intake of liquid creates, at the liquid inlet 9, an application force S which also has a tendency to hold the device in contact with the immersed surface.

The pressure torque brought about by the longitudinal component Fel of the hydraulic reaction force Fe must also not be excessive, in order to allow the device to pass the wall base, that is to say, to allow the front portion of the device to lift under the driving effect M brought about by the front wheels 2 when they come in contact with a vertical wall 53. This contact is maintained with a force which is sufficient to allow the front wheels 2 to travel without sliding on the vertical wall 53 owing to the longitudinal component Fel of the hydraulic reaction force Fe which presses the device against the vertical wall 53, the front wheels 2 coming into contact with the vertical wall 53 in accordance with a contact zone 54 which is located in the horizontal plane of the rotation shaft 60 of the front wheels 2 and at the front thereof, as illustrated in FIG. 5.

As can be seen in FIG. 5, the device which is rolling on a horizontal base 52 is driven forwards by the front drive rolling member 2 and by the longitudinal component Fel of the hydraulic reaction force Fe. Upon arrival at the base of a vertical wall 53, the front rolling member 2 come into abutment against this wall 53. Since the longitudinal component Fel of the hydraulic reaction force Fe presses the front drive rolling member 2 against the vertical wall 53 at the base of the wall, the front drive rolling member 2 travel over the vertical wall 53 without sliding on it and cause the front portion of the device to be lifted until it is moved completely against the vertical wall 53, in the vertical position, that is to say, with the longitudinal direction orientated vertically.

In the vertical position, the apparent weight Pa of the device generates an inversion torque which tends to lift the front axle thereof from the vertical wall. The resultant of this inversion torque created by the apparent weight Pa of the device immersed in the liquid when it is rolling over a vertical wall, and of the application force S of the device on the immersed surface created by the intake of liquid in the liquid inlet 9 also forms a total inversion torque which tends to lift the front axle of the device from the vertical wall. In a device according to the invention, the longitudinal component Fel of the hydraulic reaction force Fe must be adapted so that the value of the pressure torque generated by this longitudinal component Fel is greater than that of this total inversion torque. In this manner, the front wheels 2 are kept pressed against the vertical wall 53 with a force which is sufficient to allow the front drive wheels 2 to drive the device forwards with a drive force M.

Preferably, the value of the pressure torque is greater than that of the inversion torque created by only the apparent weight Pa of the device immersed in the liquid when it is rolling over a vertical wall. In this manner, the device is held in contact with a vertical wall 53 even if the application force S of the device against the wall owing to suction is not significant. However, the value of the pressure torque must also not be excessive in order, on the one hand, not to prevent the base of the wall from being passed as described above, and, on the other hand, not to bring about alone untimely lifting of the rear axle when the device is rolling over a vertical wall or over a horizontal wall or other type of wall.

This appropriate value of the pressure torque can be adjusted by amending different production parameters of the device. A first parameter involves a configuration of the shape of the end portion of the hydraulic circuit which brings about an appropriate corresponding position of the center of pressure C, in particular optimal values of the distance dc and the difference between the distances dc and dg. Another parameter involves adjusting the value of the amplitude of the longitudinal component Fel of the hydraulic reaction force Fe. This amplitude value is itself dependent, on the one hand, on the flow of liquid discharged via the rear liquid outlet 10 and, on the other hand, the inclination β of the flow relative to the longitudinal direction and the rolling plane 50. However, an inclination β which is not equal to zero also has the advantage of generating an application component Fen which presses the device against the vertical wall. The flow is influenced by the power of the pumping motor, by the pumping performance levels of the propeller and by the hydrodynamic performance levels of the outlet 10.

The control of the device when it arrives at the water line is not significant in the context of the present invention and can be carried out in accordance with any manner well known per se.

Furthermore, the longitudinal component Fel of the hydraulic reaction force Fe must be capable alone of moving the device forwards and upwards when it is immersed, when each front drive rolling member 2 is lifted from the immersed surface, and when the device is resting with the base of the hollow body in contact with a stair nosing. In particular, the longitudinal component Fel of the hydraulic reaction force Fe must be capable of moving the device forwards and upwards when the longitudinal direction forms with the horizontal an angle γ between 0° and 85°. Preferably, the longitudinal component Fel must be capable alone of moving the device forwards and upwards for any angle γ between 0° and 90° (the drive wheels 2 being lifted from the immersed surface).

In this manner, the device is able to move over steps as illustrated in FIG. 6, using a minimal amount of energy.

In a first step, when the device encounters a first step, the front portion thereof is raised in the same manner as at the base of a wall as explained above (device A1 FIG. 6). The front wheels 2 pass the stair nosing until the lower wall of the base of the hollow body located immediately behind the front wheels 2 comes into contact with the stair nosing (device A2 FIG. 6). The front wheels 2 are lifted from the wall of the immersed surface and are no longer operational for driving the device.

From this position, under the action of the longitudinal component Fel of the hydraulic reaction force Fe, the device continues to move forward with the lower wall which slides over the stair nosing, the front drive wheels 2 being lifted from the immersed surface (device A3 FIG. 6).

The driving of the device using only the longitudinal component Fel of the hydraulic reaction force Fe must be sufficient for the corresponding pressure torque to bring about a tilting of the device, the front portion thereof falling onto the subjacent step (device A4 FIG. 6). It should be noted that, taking into account the pressure torque, this tilting occurs even before the apparent center of gravity Ga passes the vertical of the stair nosing. The front wheels 2 come into contact with the immersed surface and continue driving the device.

In the example illustrated in FIG. 6, the position of the device from which the front wheels 2 pass the stair nosing and are lifted from the immersed surface (device A2 FIG. 6) is the one in which the inclination γ of the longitudinal direction thereof relative to the horizontal is at a maximum (γmax). The device according to the invention must be suitable, in this position and with this maximum inclination γmax, for the longitudinal component Fel of the hydraulic reaction force Fe alone to ensure that it is driven forwards and upwards. In practice, with the majority of standard swimming pool steps, this maximum inclination γmax is between 70° and 85°.

Preferably, in order to clean the steps, the length of the front portion of the device extending between the apparent center of gravity Ga and the extreme front portion thereof (which is that of the front wheels 2) must be less than the length of a step. For example, since the standard length of a step is between 25 cm and 35 cm, the length of the front portion of the device extending between the apparent center of gravity Ga and the extreme front portion thereof is less than 35 cm, in particular in the order of from 20 cm to 30 cm. In this manner, the front wheels 2 come into contact again with the horizontal portion of the front step before climbing over the subsequent stair nosing. However, this condition is not necessary to allow the device to move forward and over the steps.

With a device according to the invention, the electric motors may have reduced performance levels, and the total amount of electrical energy consumed is minimized. Furthermore, the suction and driving performance levels are improved. Also, the invention allows the device to be configured with a small height which results in low hydraulic drag.

For example, a device according to the invention which is produced with an overall height of 250 mm and which is provided with an electric pumping motor with a power of 80 W allows a flow of liquid to be produced in the order of 18 $m^3/h$. The total power consumed for the operation of this device driven at a mean speed in the order of 10 m/min is approximately 85 W.

In comparison, a prior device in accordance, for example, with WO 0250388 which is provided with the same pumping motor and which has the same overall height produces a flow in the order of 15 $m^3/h$. Furthermore, the total power consumed for the operation of this prior device driven at the same mean speed is in the order of 105 W.

Therefore, it is found that a device in accordance with the invention shows an improvement in performance levels of approximately 20% in relation to a comparable prior device in accordance with WO 0250388.

Of course, the invention may have a number of construction variants and applications. In particular, the sizing and the configuration of the device, in particular the hydraulic circuit thereof, are subject to an infinite number of variants. Furthermore, the invention can be used for a bi-directional device which is capable of backward movement during normal cleaning operation.

The invention claimed is:

1. A swimming pool cleaner configured for travel along an immersed surface in at least a forward direction and comprising:

a. a body comprising an inlet, a front portion, and a rear portion having a width and an outlet positioned centrally along the width;

b. a first rolling member proximate the front portion of the body;

c. a motor coupled to the first rolling member so as to move the body when the first rolling member is in contact with the immersed surface; and d. a pumping device configured to cause water to flow from the inlet to the outlet, discharge of the water from the outlet creating a hydraulic reaction force having a longitudinal component sufficient to move the body in the forward direction when the first rolling member is not in contact with the immersed surface.

2. A swimming pool cleaner according to claim 1 in which the direction of the water discharge from the outlet forms an angle β greater than 0° and less than 45° with the forward direction.

3. A swimming pool cleaner according to claim 1 in which the longitudinal component of the hydraulic reaction force is sufficient to move the body both forward and upward when the body is upright and contacts a stair nosing within a swimming pool.

4. A swimming pool cleaner according to claim 1 in which, when the immersed surface is horizontal and the body is upright, the longitudinal component of the hydraulic reaction force is sufficient to move the body forward when it forms an angle between 0-85° with the immersed surface.

5. A swimming pool cleaner according to claim 1 in which the body is configured such that, when the body is upright, the water discharge from the outlet creates a downward pressure torque on the rolling member.

6. A swimming pool cleaner according to claim 2 in which the pumping device comprises an axial pumping propeller having an axis of rotation inclined relative to the forward direction through an angle five degrees smaller than angle β.

7. A swimming pool cleaner according to claim 1 further comprising a second rolling member proximate the rear portion of the body and not coupled to the motor.

* * * * *